United States Patent [19]

Neyraud

[11] 3,941,161

[45] Mar. 2, 1976

[54] JACQUARD REVERSING MECHANISM FOR LOOMS

[75] Inventor: Rene Neyraud, Saint-Cyr, Au Mont D'or, France

[73] Assignee: Verdol S.A., Caluire, France

[22] Filed: Sept. 20, 1974

[21] Appl. No.: 507,905

[52] U.S. Cl. ..... 139/1 E; 139/329

[51] Int. Cl.[2] ..... D03C 3/32

[58] Field of Search ..... 139/1 R, 1 E, 59, 317, 139/324, 328, 329

[56] References Cited

UNITED STATES PATENTS

| | | | |
|---|---|---|---|
| 3,117,599 | 1/1964 | Strach | 139/329 |
| 3,318,341 | 5/1967 | Nollet | 139/1 E |
| 3,732,895 | 5/1973 | Keim | 139/1 E |

*Primary Examiner*—Henry S. Jaudon
*Attorney, Agent, or Firm*—Dowell & Dowell

[57] ABSTRACT

In a double-left Jacquard of the Verdol type in which the cam system adapted to actuate the pusher grid must be displaced angularly on its driving shaft between a first and a second position, or vice versa, whenever the direction of rotation of the loom is reversed, a reversing mechanism is provided by which this displacement is automatically accomplished when the Jacquard starts rotating. For this purpose said cam system, loosely journaled on its driving shaft, has a gear wheel which meshes with a first planet gear, the shaft of which is supported by a planet carrier keyed on the driving shaft. The planet shaft carries a second planet gear which meshes with a toothed sector carried by a drum having a limited angular freedom on the driving shaft and subjected to the action of a brake. Means are provided to release the brake when the cam system has been displaced. Other means render the brake ineffective as long as the Jacquard is at such a point of its operative cycle that displacement of the cam system would be liable to damage parts of the Jacquard. A Maltese cross mechanism locks the planet gears when the cam system has reached either one of its first and second positions on said driving shaft, the angle of freedom of the drum on the driving shaft being greater than the angular extent of the toothed sector.

11 Claims, 12 Drawing Figures

Fig. 6
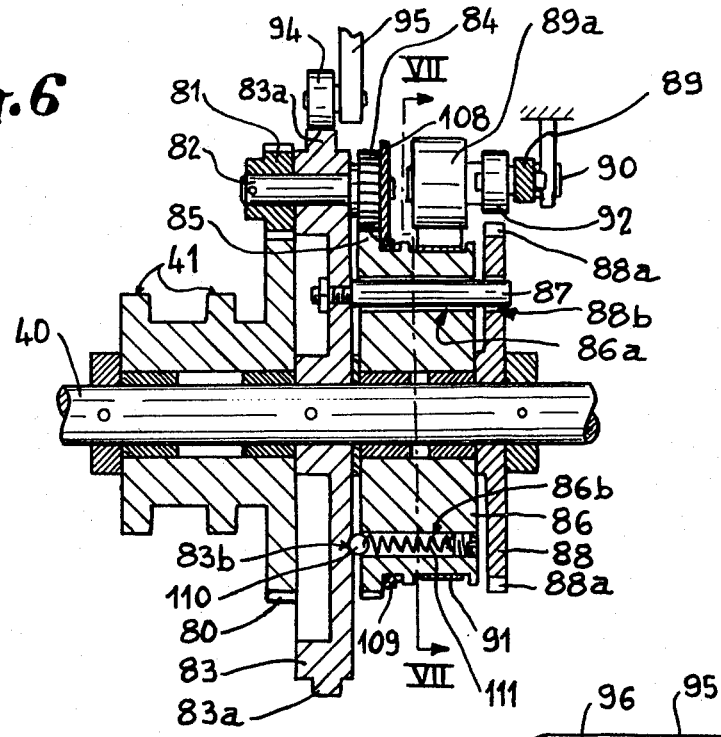
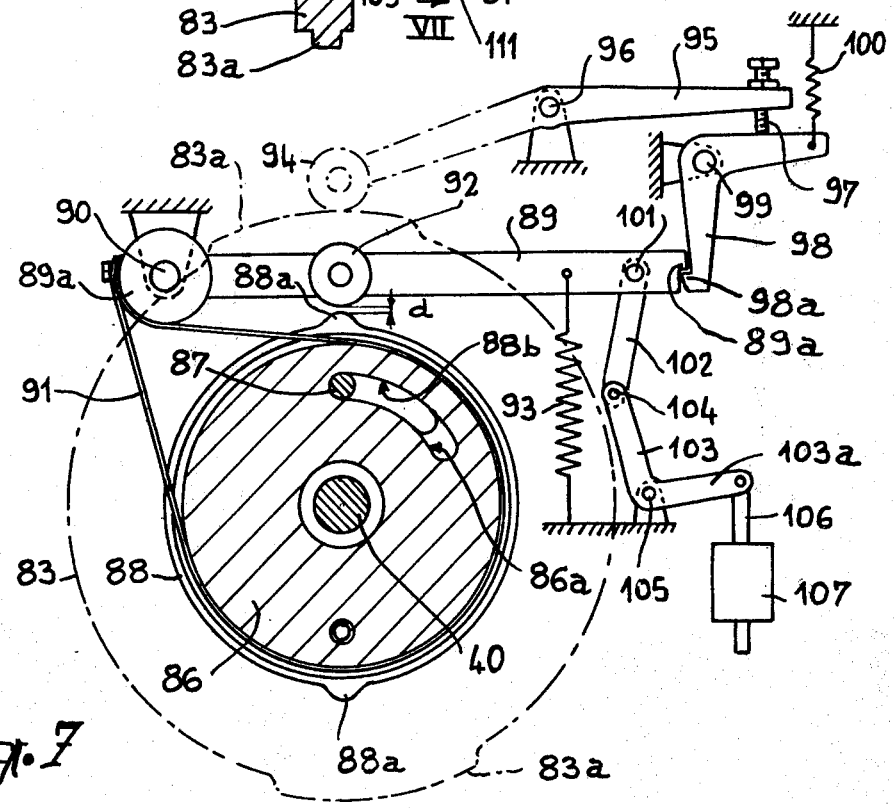
Fig. 7

JACQUARD REVERSING MECHANISM FOR LOOMS

In loom Jacquard, and more particularly in those of the Verdol type, it is known practice to obtain a correct operation when the loom is running backwards by displacing angularly on its driving shaft the cam system which actuates the pusher grid to press the needles.

This angular displacement of the pressing cam system should of course take place while the loom is at standstill and before it is started in the reverse direction. The cam system is then positioned by causing it to rotate on a stationary shaft. But this rotation of the cam or cams with respect to the Jacquard frame may act on the pusher grid which then pushes the needles and the hooks. If the latter are at that time free, this has no damageable consequence; if they are at their highermost or raised position, they merely flex to a limited extent and are not damaged; but if they are retained in the vicinity of their lowermost position by a knife frame, their ability to flex is of a quite limited length and results in considerable bending stresses which may lead to permanent deformation. The angular displacement of the cam system should therefore only be effected when the loom is at standstill at such a position of its operative cycle that no hook is retained in its substantially lowered position. This of course necessitates a careful operator.

Furthermore the prior art cam displacing mechanism had normally to be actuated either by hand or by a separate electric motor. The first solution is tiresome and the second one increases in a substantial manner the manufacturing cost of the Jacquards.

It is an object of the present invention to provide a Jacquard in which the mechanism which displaces the pusher grid driving cam system is automatically actuated by the power of the motor which drives the loom and the Jacquard whenever the loom is started in the reverse direction with respect to its previous running period.

Another objec of the invention is to provide means which whereby, if the loom is started from such a position that the angular displacement of the pusher grid driving cam system would be liable to damage some of the hooks, this displacement will be delayed until a favourable position is reached.

In accordance with the present invention there is provided a mechanism which displaces angularly the pusher grid driving cam system on its shaft through a predetermined angle whenever this shaft is started in the reverse direction with respect to its former rotating period, means being provided to maintain this mechanism ineffective as long as the Jacquard is in the portion of its operative cycle in which the hooks would be liable to be damaged.

In the annexed drawings;

FIG. 1 is a diagram illustrating the motions of the knife frames in a double-lift Verdol Jacquard.

FIG. 2 indicates the corresponding motion of the pusher grid and of the presser rods associated therewith.

FIG. 6 is a longitudinal section through a displacing mechanism according to the invention.

FIG. 7 is a transverse section taken along line VII—VII of FIG. 6.

Figure 10:
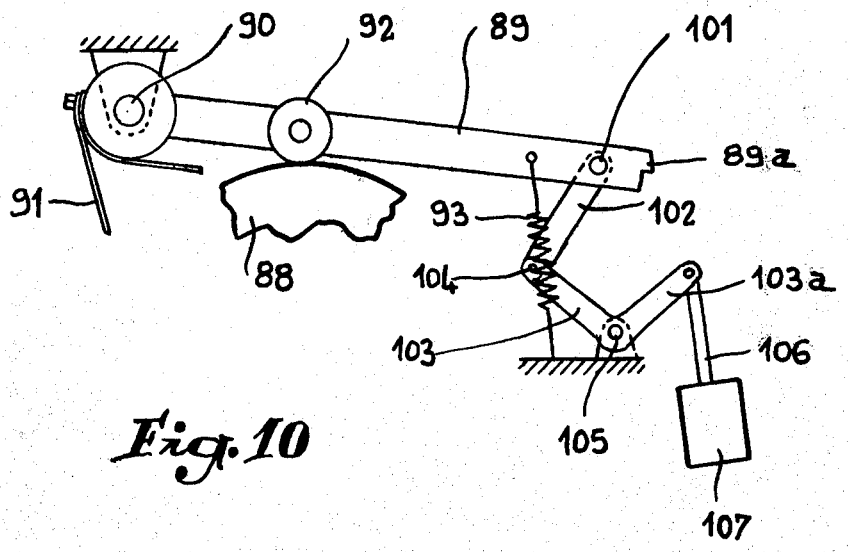

FIG. 10 partially reproduces FIG. 7, but showing the braking lever in its operative position.

Figures 1, 2, 3, 4, 5, 11:
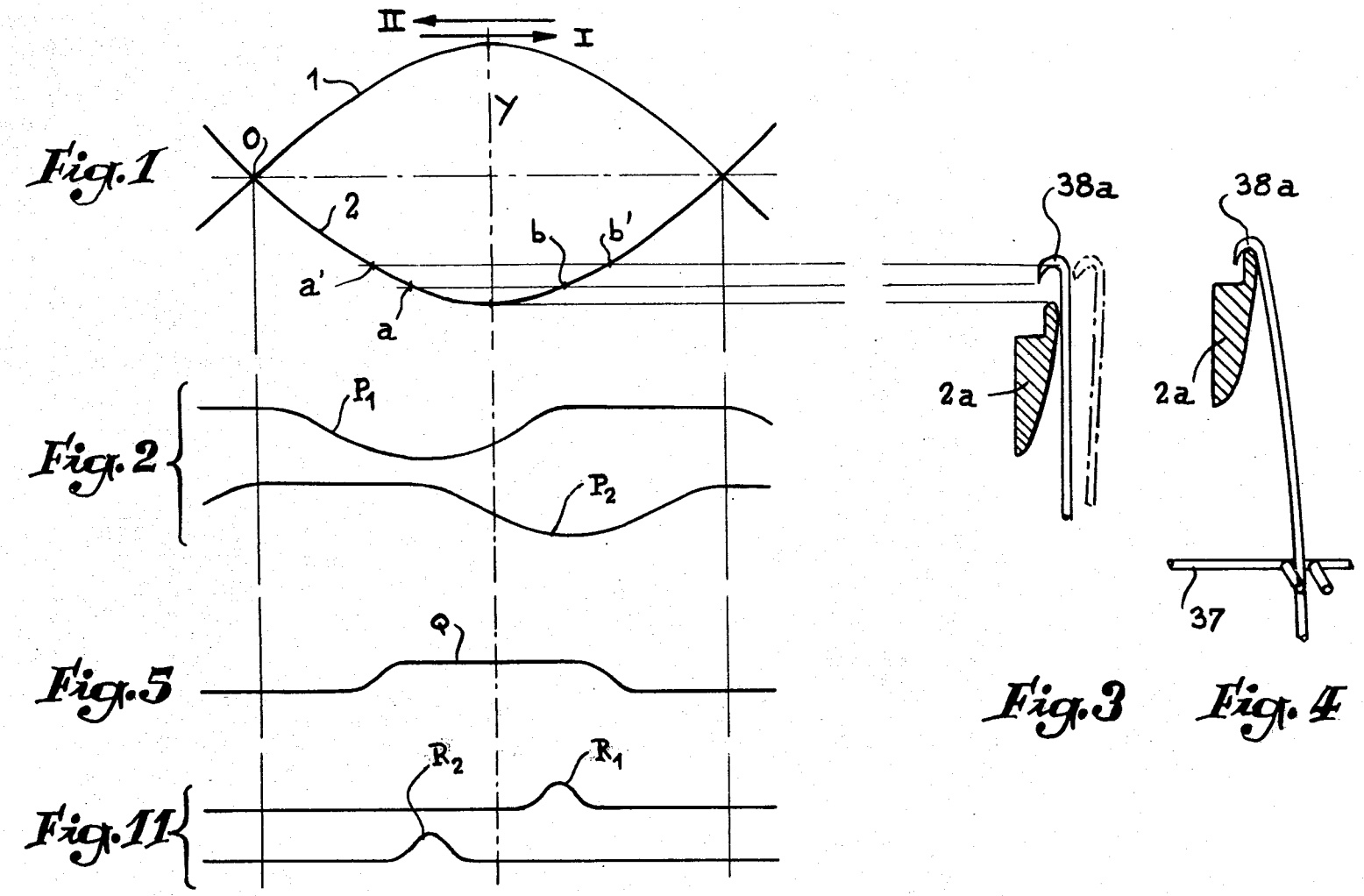
FIGS. 3 and 4 are diagrammatical sections showing a hook and the corresponding knife respectively at the lowermost position of the knife and at another position situated in the vicinity of the latter.
FIG. 5 illustrates in correspondence with the diagram of FIG. 1 the portion of the cycle in which the angular displacement operation should be avoided for forward running as well as for backward running.

FIG. 11 illustrates in correspondence with the diagram of FIG. 1 the two points in the cycle which correspond to the action of the braking lever raising cam, respectively during forward running and backward running.

Figure 12:
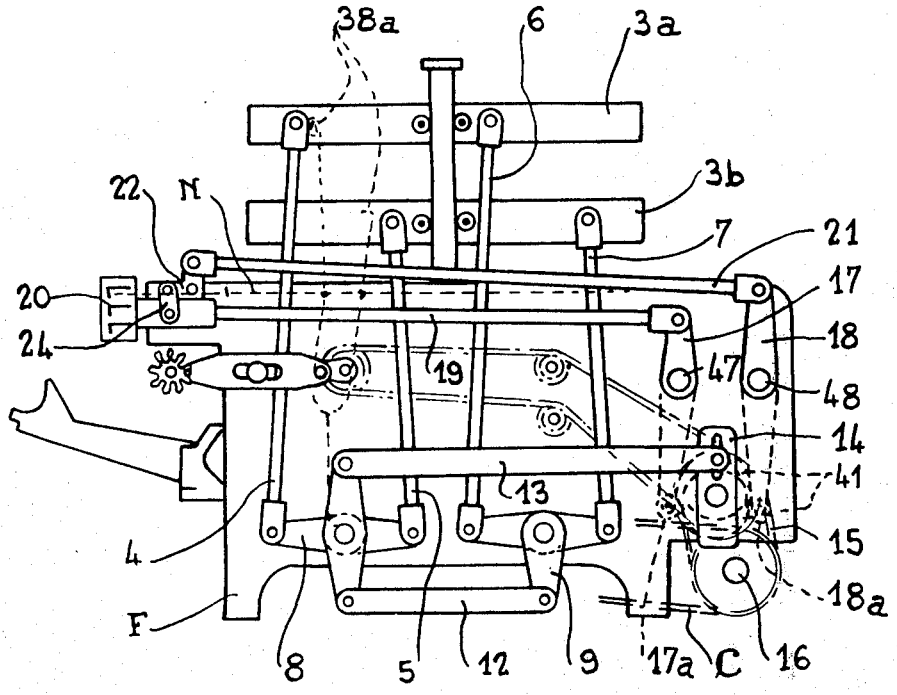
Fig. 12 (PRIOR ART)

FIG. 12 is a side elevation showing a prior art Jacquard mechanism of the Verdol type to which the reversing mechanism of the present invention applies.

Referring now to the drawings, FIG. 12 shows a Jacquard of the Verdol type which will be described first in order to provide a background for the present invention. F designates the frame and 20 represents the pusher grid which is oscillated horizontally to actuate the needles N and vertically to effect the selection of these needles. The pusher grid 20 is coupled with two longitudinal rods 19 (one each side of the frame) which are supported by links 24. Each link 24 is pivoted to the horizontal arm of a pivotally mounted two-armed lever 22 reciprocated by a longitudinal rod 21. Rods 19 and 21 are pivotally attached to actuating levers 17 and 18 which include lower extensions mounting cam followers 17*a*, 18*a* and carried by transverse shafts 47 and 48 rotatably mounted in Frame F. Each of these shafts is oscillated by cams 41, these cams being mounted on a transverse shaft 40. The shaft carries at each end a crank 14 which actuates a longitudinal rod 13 adapted to oscillate the griffe frames 3*a* and 3*b* vertically through levers 8 and 9 and through longitudinal rod 12 and vertical rods 4, 5, 6 and 7. Shaft 40, which is the main shaft of the Jacquard, is connected by a chain 15 with a power input shaft 16, the latter being in turn connected by a chain C with the drive shaft of the loom with which the Jacquard is associated. The Jacquard as set forth in FIG. 12 is the subject of French Pat. No. 2,131,138 issued Nov. 10, 1972 to the French Company Verdol S.A. which is the owner of the present invention, now discussed with reference to FIGS. 1 through 11.

Referring to FIG. 1, reference numerals 1 and 2 designate the diagram of the motion of the knife frames in a doublelift Verdol Jacquard, these frames being reciprocated in opposed directions. Curve P1 in FIG. 2 corresponds to the horizontal motion of the pusher grid 20 during normal forward running (the diagram being read from left to right in accordance with arrow I). Also in FIG. 2 curve P2 represents this same motion during backward running, the diagram then being read from right to left (arrow II). Curves P1 and P2 are symmetrical with respect to a vertical axis Y which intersects respectively the highermost and lowermost points of curves 1 and 2 in FIG. 1.

When it is desired to displace angularly the pusher grid 20 the driving cam system 41 in such a Jacquard, with the loom being at standstill, it is necessary to take into account the fact that this displacement may cause actuation of the needles N which then act in turn on the corresponding hooks 38*a*. Three cases are to be considered:

1. The hook 38*a* (FIG. 3) under consideration has been fully lowered (it rests on the bottom board of the Jacquard) and the knife frame 2*a* which is near its lowermost position has fully cleared the nose of the hook. At such a time the hook is free and if its needle N is pushed, this has no inconvenience. The hook is only deflected as indicated in dotted lines.
2. The hook 38*a* is retained at its raised position, or in the immediate vicinity of the latter by the knife frame which is near its highermost position or by the stationary open-shed frame. Under these conditions the movement of the corresponding needle 37 causes this hook to flex; but since the flexion extends over a major length of the hook stem (between the needle and the hook nose), it has therefore no permanent deformation effect on the hook which behaves as a resilient wire.
3. The knife frame when near its lowermost position still retains the nose of the hook 38*a* or has just begun its ascending movement and has caught this nose. The displacement of the needle here again causes the hook to flex, but the length of the hook stem to which this flexion is imparted (between the needle and the lowered nose) is now quite short and the hook may therefore undergo a permanent deformation, or in other words it is liable to be damaged.

In FIG. 1 points *a* and *b* define the zone or portion of the Jacquard operating cycle in which the lowered hooks are fully disengaged from the knives and in which therefore the angular displacement of the cam system 41 may be effected without inconvenience while the loom is at standstill. Zones *a–a* and *b–b* indicate the portions of the operating cycle which correspond to the disengagement and to the re-engagement of the lowered hooks with respect to the adjacent knives.

If now in accordance with the present invention the displacement of the pusher grid driving cam system 41 will no longer take place while the loom remains at standstill, but on the contrary should result from its re-starting for instance backwards, this means that during the re-starting period the curve P1 of FIG. 2 should be brought to the position P2 before the representative point has left zone *a–b* in FIG. 1. It is easy to see that this is tantamount to saying that the angular displacement of the pressing cam system should not begin in a portion of the cycle which, in order to include both cases (re-starting backwards and re-starting forwards), should extend symmetrically both sides of axis Y. Taking into account the fact that the angular displacement of the cam system is not immediate but occurs during a substantial portion of the Jacquard operative cycle, it is finally possible to define a curve Q (FIG. 5) which represents the respective portions of the cycle wherein the beginning of this angular displacement of the pressing cam system by the loom itself is possible, or conversely should be avoided.

The mechanism according to the present invention comprises a pusher grid driving cam 41 (FIG. 6) freely journaled on the main shaft 40 of the Jacquard mechanism and rotatably driven by and in synchronism with the loom drive through chain C (FIG. 12). If more than one cam is used, they may be rigidly mounted on a common sleeve. In the example illustrated this cam is of the double-acting type in order to achieve a positive or bi-directional drive. Cam 41 is unitary with a gear wheel 80 which meshes with a planet gear 81 keyed on a secondary shaft 82 parallel to shaft 40 and rotatably carried by a supporting plate 83 keyed on shaft 40. This secondary shaft 82 has keyed on its end situated on the other side of plate 83 with respect to planet gear 81 another or second planet gear 84 which is in meshing engagement with a toothed sector 85 integral with a drum 86 journaled on shaft 40. As shown in FIG. 7 drum 86 is provided with an arcuate slot 86*a* concentric to shaft 40 and which slidably receives a pin 87 secured to plate 83 in parallel relation to shaft 40. It will be understood that with such an arrangement free rotation of drum 86 on shaft 40 is limited to the angular extent of slot 86*a*.

Shaft 40 further carries a flat cam 88 freely journaled thereon. This cam is in the form of a disc having two diametrically opposed bosses 88*a* (FIG. 7) of relatively short peripheral length and an arcuate slot 88*b* for passage of pin 87, this slot extending angularly somewhat less than slot 86*a*.

Figure 8:
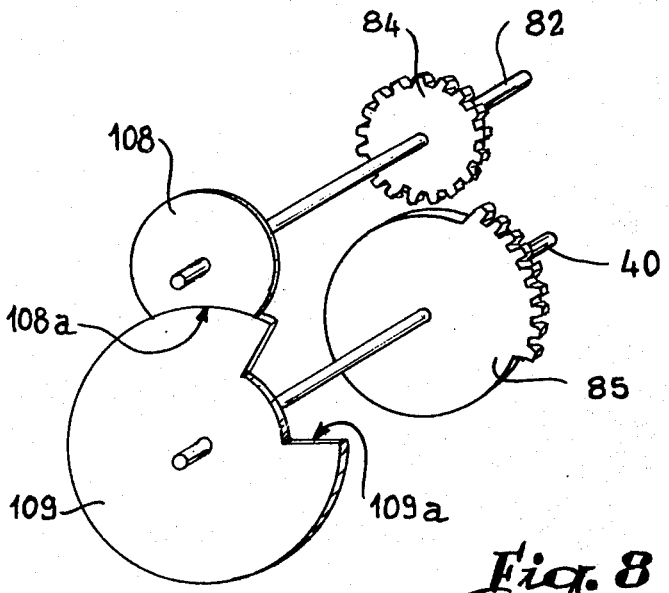
FIG. 8 is a perspective view of the planet gear locking device in the mechanism of FIGS. 6 and 7.

The mechanism of FIGS. 6–8 further includes a lever 89 (FIG. 7) pivoted to the stationary frame (not fully illustrated) of the Jacquard on a pin 90 parallel to shaft 40. Lever 89 has a hub 89*a* on which are wound both ends of a braking band 91 passed around drum 86. Lever 89 also carries a freely rotating roller 92 adapted to cooperate with the flat cam 88, and it is urged towards the said cam by spring 93. It will be observed that under the action of spring 93 hub 89*a* tends to pull the ends of band 91 and to apply same against drum 86.

The periphery of the supporting plate 83 is formed with two diametrically opposed bosses 83*a* of relatively elongated shape (see FIG. 7 wherein plate 83 has been indicated in dash and dot lines since it is in front of the plane of section VII—VII of FIG. 6). These bosses actuate a roller 94 carried by a lever 95 mounted on a spindle 96 rotatably supported by the Jacquard frame. Arm 95 is bent laterally and it extends beyond spindle 96 to carry at its end opposed to roller 94 an adjustable screw 97 which may act on one of the arms of a bell-crank lever 98 pivoted to the frame at 99. The second arm of lever 98 has a latch 98*a* adapted to retain a tooth 89*b* formed on the free end of lever 89 against the action of spring 93 at such a position that roller 92 is not engaged by bosses 88*a* (distance *d* in FIG. 7). A spring 100 acts on lever 98 in such a direction as to tend to disengage latch 98*a* from tooth 89*b*.

Lever 89 carries in the vicinity of its free end a pin 101 on which an arm 102 is pivoted through one of its end, its other end being hinged at 104 to an arm 103 pivoted at 105 to the Jacquard frame. Arm 103 has a lateral extension 103*a* which is actuated by the movable core 106 of the electromagnet 107.

Planet gear 84 has affixed to it a Maltese Cross mechanism comprising a disc 108 having in its periphery a concave arcuate depression 108*a* (see FIG. 8). The toothed sector 85 also carries another disc 109 the periphery of which may fit within depression 108*a*. This disc 109 has in its periphery an angular zone of lesser diameter which determines therein a recess 109*a* defined by two radial edges. As clearly illustrated in FIG. 8, discs 108 and 109 cooperate with each other somewhat as the wheels of a Geneva cross system. If, starting from the position of FIG. 8, sector 85 and disc 109 are rotated counterclockwise, when the leading edge of recess 109*a* reaches the center line of discs 109 and 108, disc 108 is free to rotate clockwise. But at the same time the toothed portion of sector 85 engages planet gear 84 which is thus rotated positively in the clockwise direction for exactly one revolution, depression 108*a* being thus returned to its initial position. In the meantime however the trailing edge of recess 109*a* has reached the center line of discs 109 and 108, whereby disc 108 is again locked angularly together with shaft 82 and planet gear 84. Sector 85, now disengaged from planet gear 84, continues rotating until it reaches a position symmetrical with the position illustrated in FIG. 8 with respect to the common plane of shafts 40 and 82, the trailing edge of recess 109*a* being beyond depression 108*a*.

Drum 86 has a longitudinal bore 86*b* (FIG. 6) in which a ball 110 is urged by a spring 111 against the adjacent side of plate 83, this side being formed with two depressions to receive ball 110, drum 86 being thus resiliently retained with respect to plate 83 at the position corresponding to FIG. 8 and at the above-mentioned symmetrical position. The angular extent of slot 86*a* is such that at each of these two extreme positions pin 87 engages one end of the said slot.

Figure 9:
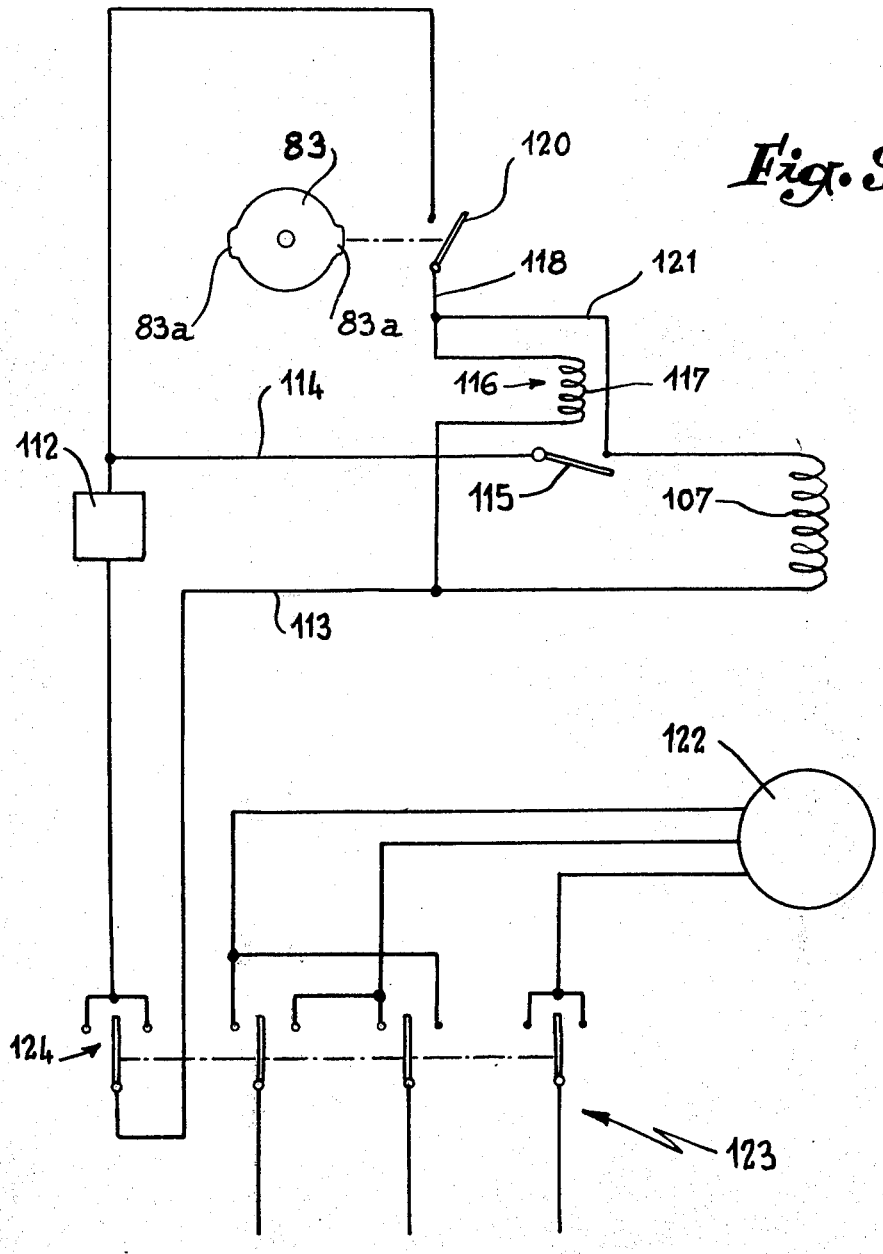
FIG. 9 is an electric diagram indicating the controlling means for the electromagnet in the mechanism of FIGS. 6 and 7.

FIG. 9 shows the electric diagram associated with electromagnet 107. In this diagram reference numeral 112 designates a source of electric current, as for instance one phase of an A. C. network, a low voltage transformer, or a rectifying circuit adapted to supply D. C. power, etc... The connection between source 112 and electromagnet 107 is effected by two wires 113, 114. Wire 114 includes the movable contact 115 of the relay 116 having a coil 117 one end of which is directly connected with wire 113 while its other end is connected with wire 114 through another wire 118 including a movable contact 120. The latter is normally closed (as for instance under the action of a spring not illustrated), but it is opened by plate 83 each time the latter actuates roller 94. For this purpose contact 120 may be so arranged as to be engaged by one of the bosses 83*a* of the said plate (the lower one in FIG. 7) while the other one (the upper one in FIG. 7) engages the said roller. It will further be noted that a wire 121 connects the end of coil 117 which is connected with movable contact 120, with the end of electromagnet 107 which is connected with movable contact 115.

FIG. 9 further shows the electric motor 122 which drives the loom (together with its Jacquard) and its three-pole reversing switch 123. As illustrated the latter includes an auxiliary contact 124 which is interposed on wire 113, this contact being closed whenever motor 122 is running in any direction.

The operation is as follows:

When the loom is in operation, as for instance forwards, pin 87 is at the leading end of slots 86*a* and 88*b* in order to drive cam 88 and drum 86. The latter is besides resiliently retained in both directions with respect to plate 83 by ball 110 urged into one of depressions 83*b* under the action of spring 111. The pusher grid driving cam 41 is at the appropriate angular position on shaft 40 for normal forward running. Contact 115 is retained at the closed position by coil 117 of relay 116 and electromagnet 107 is therefore energized. The arrangement is such that arms 102 and 104 are thus maintained almost in line but nevertheless at a small angle to each other, as illustrated in FIG. 7. At such a position these arms 102, 103 retain lever 89 at the raised position for which band 91 is loose on drum 86 and therefore has practically no braking action thereon.

When the loom has to be operated backwards, the operator first brings switch 123 to its neutral position to stop the loom. In most cases the loom stops at such a position that neither rolller 92, nor roller 94 are raised by their respective bosses 88*a* and 83*a*. It results therefrom that under the action of spring 100 the latch 98*a* is at its ineffective position with respect to tooth 89*a*. Since at the neutral position of switch 123 (FIG. 9) contact 124 is now open, electromagnet 107 is disenergized and lever 89 is lowered by spring 93, as illustrated in FIG. 10 which shows the out-of-alignment or "broken" position then assumed by arms 102, 103, the roller 92 engaging the periphery of the circular portion of cam 88. At this position of lever 89 band 91 is pulled by hub 89*a* which acts as a winding member, and it exerts a strong braking action on drum 86.

When the operator again closes switch 123 to start motor 122 in the reverse direction, shaft 40 begins rotating without driving drum 86 which is sufficiently braked by band 91 to cause ball 110 to leave depression 83*b* (FIG. 6) against the action of spring 111, while pin 87 moves freely in slots 86*a*, 88*b*. Planet gear 84 therefore rotates around sector 85 in the manner already explained with reference to FIG. 8, namely that the said gear is first unlocked by reaching the recess 109 in the disc 108, then that it is engaged by the teeth of sector 85 and rotates through one full revolution together with shaft 82 and planet gear 81, and that thereafter pin 87 engages the end of slot 86*a* thus causing rotation of drum 86 in spite of the braking action of band 91. Owing to the rotation of the planet gear 81 as the drum 86 is rotated and to the meshing engagement of planet gear 81 with gear wheel 80, the pusher grid driving cam 41 is also angularly displaced on shaft 40 and the arrangement is such that this displacement corresponds exactly to the amount required to obtain proper operation of the Jacquard during backward rotation of the loom.

As aforesaid when pin 87 reaches the end of slot 86*a*, ball 110 is urged by spring 111 into the other depression 83*b* to releasably retain drum 86 in both directions.

When switch 123 (FIG. 9) has been closed to start motor 122 backwards, contact 124 has energized electromagnet 107 through contact 120 which was closed at that time because the switch 120 is only opened by one of the elongated bosses 83*a* when the other one raises roller 94, and it having been assumed as a starting condition that such was not the case. Relay 116 has operated to close contact 115 whereby contact 120 is now short circuited. Owing to the energization of electromagnet 107, arm 103 tends to rotate clockwise from the "broken" position of the arms 102–103 as shown in FIG. 10, but at the "broken" position of arms 103–102, the force developped by the said electromagnet is insufficient to raise lever 89. However as soon as a boss 88*a* raises roller 92, electromagnet 107 may then act on lever 89 to further raise same through the small distance *d* of FIG. 7 above bosses 88*a*, as this is necessary to bring tooth 89*a* above latch 98*a*. It should be noted in this respect that some sort of abutment is provided, as for instance within electromagnet 107, to limit the ascending movement of lever 89 and to prevent arms 102 and 103 from becoming fully aligned, which of course would block the release of the mechanism back to "broken" position as shown in FIG. 10. Owing to the counterclockwise rotation of lever 89, band 91 is released and drum 86 is no more braked.

It may be remarked that contact 120 being short-circuited by contact 115, the brief periodic openings of this contact by bosses 83*a* on switch 120 will have no influence on electromagnet 107.

If however when the loom is to be started backwards the representative point of the operative cycle is in the "forbidden" zone of FIG. 1, i.e. where roller 94 rests on one of the elongated bosses 83*a* of plate 83 (see FIG. 7) and lever 95 has been rotated clockwise and latch 98*a* has been brought under tooth 89*a* before disenergisation of electromagnet 107, then the lever 89 will be maintained at the released position of band 91 and drum 86 is not braked. Furthermore contact 120 is opened by the boss 83*a* opposed to the one which raises roller 94 and therefore neither relay 116, nor electromagnet 107 is energized when the operator actuates switch 23 to start the loom backwards.

But as soon as the upper boss 83*a* releases roller 94, the latch 98*a* is brought to its ineffective position by spring 100 and lever 89 will have to come to the position of FIG. 10 before contact 120 is closed to energize electromagnet 107. The cam displacing operation has thus been delayed during the forbidden zone, but will thereafter take place as above explained.

It should be observed that if when the loom is at standstill roller 92 were raised by the boss 88*a*, thus preventing lever 89 from operating the band 91 to brake the drum 86, this would have no consequence since contact 120 is then open and therefore electromagnet 107 is unenergized and cannot retain lever 89 at the fully raised position.

It will be understood that the short bosses 88*a* have for their purpose to raise lever 89 after passage of an elongated boss 83*a* under roller 94 in order that the said lever 89 may be brought by electromagnet 107 to the position illustrated in FIG. 7 (roller 92 being at a distance *d* above the level of bosses 88*a*). When the loom is reversed the flat cam 88 should therefore be somewhat displaced with respect to plate 83 and that is why it is driven by means of pin 87 in the slot 88*b* which, as illustrated, may be noticeably shorter than the slot 86*a* of drum 86, the extent of the latter having to correspond to a full operative cycle of the gearing illustrated in FIG. 8. FIG. 11 shows in correspondence with the diagram of FIG. 1 the times $R_1$ and $R_2$ at which the bosses 88*a* of cam 88 should act on roller 92 respectively when the loom is operated forwards and backwards. It will be observed that $R_1$ and $R_2$, which represent the short bosses 88*a*, are below the curve Q of FIG. 5 which corresponds to the elongated bosses 83*a*. It is clear that bosses 88*a* only raise lever 89 when roller 94 is raised and while therefore contact 120 is open.

Discs 108 and 109 have for their purpose to prevent the pusher grid driving cam 41 from retroacting on drum 86 under the effect of the reactions of the pusher grid 20, such reactions acting alternately in one and the other direction. As to the resilient locking ensured by ball 110, it retains the drum against vibrations.

When AC power is supplied to the electric source 112, as for instance when the latter includes a transformer, this power may be derived directly from two terminals of motor 122, which is under the control of switch 124.

It will be further understood that the double planet gearing 81–84 permits the obtaining of a multiplication of angular motion between the angular displacements of drum 86 and of cam 41 with respect to plate 83 and to shaft 40. It is obviously of advantage to obtain a high multiplication of motion in order that the time required for the displacement of cam 41 may be as short as possible with respect to the operating cycle of the Jacquard, since this reduces the extent of the forbidden zone. But the torque required increases as the multiplication and the latter should be limited in order to avoid excessive stresses in the mechanism.

The preceding description is of course only illustrative and many modifications may be taken into account. For instance contact 120 could be actuated by lever 95 or by a separate cam. The flat cam 88 could also include a resilient ball-and-spring device as drum 86.

I claim:

1. In a loom Jacquard of the Verdol type associated with a loom and including a pusher grid driven by a cam system the operative position of which in the cycle of operation of the Jacquard should be displaced when the direction of rotation of said Jacquard is reversed, a mechanism comprising:

a frame;

a driving shaft rotatably supported by said frame and adapted to be connected with the loom to rotate in synchronism therewith in one or the other direction when said loom is running forward or backward, with said pusher grid driving cam system being rotatably carried by said shaft;

means to retain said pusher grid driving cam system at a first angular position on said shaft when the shaft rotates in one direction and at a second angular position on said shaft when the shaft rotates in the other direction;

means actuated by said shaft to angularly displace said pusher grid driving cam system from one of said first and second angular positions to the other whenever, after said shaft has rotated in one direction, it is started in the other direction;

and means to inhibit the action of said cam system displacing means during the portion of the operative cycle of the Jacquard wherein displacement of said pusher grid driving cam system would be liable to damage parts of the Jacquard.

2. In a mechanism as claimed in claim 1, said means to displace said pusher grid driving cam system comprising:

a driving member loosely mounted on said shaft;

abutment means interposed between said shaft and said driving member to limit to a first predetermined angle possible rotation of said member on said shaft;

means carried by said frame and acting on said driving member to brake same and further including means to rotate said driving member through said first predetermined angle on said shaft whenever the direction of rotation of said shaft is reversed;

and connecting means between said driving member and said cam system to cause the cam system to rotate through a second predetermined angle on said shaft when said driving member rotates thereon through said first predetermined angle.

3. In a mechanism as claimed in claim 2, said connecting means comprising:

a gear wheel carried by said cam system concentrically to said shaft;

a toothed sector carried by said driving member concentrically to said shaft;

a support carried by said shaft between said cam system and driving member;

and planet gear means carried by said support to mesh with said gear wheel and with said sector and to connect same with each other.

4. In a mechanism as claimed in claim 3, said planet gear means comprising a first planet gear and a second planet gear carried by a planet shaft rotatably journaled in said support, and meshing respectively with said gear wheel and with said toothed sector.

5. In a mechanism as claimed in claim 3, said means to inhibit comprising means to lock said cam system on said driving shaft at said first and second positions of said cam system thereon, and means to render said locking means ineffective whenever the rotation of said driving shaft is reversed.

6. In a mechanism as claimed in claim 4, said means to inhibit comprising:

a Maltese cross system including a first element carried by said driving member and a second element carried by said planet shaft to lock the latter at a single angular position on said support while permitting rotation of said driving member relative to said support;

said first planet gear effecting a full revolution when said cam system passes from its first to its second angular position on said driving shaft;

said sector being of such an angular extent as to rotate said second planet gear through one revolution;

and said first predetermined angle of possible rotation of said driving member on said driving shaft being greater than the angular extent of said sector.

7. In a mechanism as claimed in claim 2, means to render said braking means ineffective when said cam system has been angularly displaced on said driving shaft.

8. In a mechanism as claimed in claim 2:

said driving member having a circular periphery concentric to said driving shaft;

and said braking means including:

a. a band surrounding the periphery of said driving member;

b. a brake actuating lever to which the ends of said band are attached c. and biassing means to urge said lever in such a direction as to pull said band and to apply same on said driving member.

9. In a mechanism as claimed in claim 8:

a brake releasing cam driven by said driving shaft to displace said actuating lever against the action of said biasing means during a short portion of the operative cycle of the Jacquard to release the braking action of said band on said driving member;

and first means to retain said actuating lever at the position corresponding to the release of the braking action of said band when said cam system has been displaced on said driving shaft.

10. In a mechanism as claimed in claim 8, said means to inhibit the action of said cam system displacing means comprising:

second retaining means to retain said actuating lever at the position corresponding to the release of the braking action of said band;

second biasing means to urge said second retaining to an ineffective position;

and an inhibiting cam carried by said driving shaft to act on said second retaining means against the action of said second biasing means to cause said retaining means to retain said actuating lever during the portion of said cycle wherein displacement of said cam system would be liable to damage parts of the Jacquard.

11. In a system as claimed in claim 8, said brake releasing cam being freely journaled on said driving shaft and being driven by same through abutment means to rotate on said driving shaft through a third predetermined angle each time rotation of said Jacquard is reversed.

* * * * *

UNITED STATES PATENT OFFICE

CERTIFICATE OF CORRECTION

Patent No. 3,941,161 Dated March 2, 1976

Inventor(s) Rene Neyraud

It is certified that error appears in the above-identified patent and that said Letters Patent are hereby corrected as shown below:

-- [30] Foreign Application Priority Data

France----------73.36284 ----- Oct. 5, 1973 --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*